US005349755A

United States Patent [19]

Haywood

[11] Patent Number: 5,349,755

[45] Date of Patent: Sep. 27, 1994

[54] PORTABLE REMOTE DRUM OPENING DEVICE

[76] Inventor: Carl R. Haywood, 1023 Gardens Pl., Birmingham, Ala. 35216

[21] Appl. No.: 762,431

[22] Filed: Sep. 19, 1991

[51] Int. Cl.[5] ..... B67B 7/42; B67B 7/48

[52] U.S. Cl. ..... 30/443; 30/122; 30/361; 30/366; 81/3.2; 81/3.4

[58] Field of Search ..... 30/443, 361, 366, 122; 173/34, 35; 81/3.09, 3.15, 3.2, 3.29, 3.39, 3.4, 57.24, 57.4; 72/125; 83/745, 744, 743; 376/260

[56] References Cited

U.S. PATENT DOCUMENTS

| | | | |
|---|---|---|---|
| 755,789 | 3/1904 | Norton | 30/443 |
| 945,680 | 1/1910 | Beery | 81/57.24 |
| 953,439 | 3/1910 | Schmidt | 81/3.36 |
| 2,060,888 | 11/1936 | Newman | 30/443 X |
| 2,639,500 | 5/1953 | Gillespie, Jr. | 30/443 |
| 3,213,906 | 10/1965 | McManama | 83/745 |
| 3,618,429 | 11/1971 | Froeliger | 81/3.2 |
| 4,070,757 | 1/1978 | Granberg et al. | 83/745 X |
| 4,239,291 | 12/1980 | Skendrovic | 173/35 X |
| 4,519,276 | 5/1985 | Grabarski et al. | 81/3.09 X |
| 4,731,929 | 3/1988 | McClure | 30/361 |

*Primary Examiner*—Rinaldi I. Rada
*Attorney, Agent, or Firm*—Laurence R. Brown

[57] ABSTRACT

For safely opening drums that may contain hazardous materials, a remotely controllable drum opener attachment is provided, which is powered by air or electricity from a distance by means of a long power cord. The attachment is clamped in position on the drum by an appropriate frame.

5 Claims, 6 Drawing Sheets

PORTABLE REMOTE DRUM OPENING DEVICE

FIELD OF THE INVENTION

The present invention relates to portable remotely operable opening devices for drum type containers as they relate to hazardous materials response.

BACKGROUND—DESCRIPTION OF PRIOR ART

In the field of Hazardous Materials Response it is common to be called to respond to abandoned or discarded drum sites to identify and dispose of their contents. Some of these drums become very dangerous to handle manually due to exposure to the elements, decomposition, age, pressure build-up inside the drum, or from possible contact with the contents of the drum.

Current technologies in the field offer few solutions to this problem. The most commonly used method of handling drums of this nature is to simply open them manually, either by use of a bung wrench to remove the bung from the drum, or by puncturing the drum with some type of hand held apparatus such as an axe or pick. Workers using these methods may expose themselves to released chemicals upon opening of the drums, or may be injured, dismembered, or killed due to an explosion of unstable chemicals inside the drum.

Another commonly practiced method is to attach a spike to the bucket of a back-hoe (a tractor with a bucket attached to the end of a mechanical arm, used for digging) and have the back-hoe operator puncture the drum with the spike. Back-hoes are very expensive and not designed to be used in this manner. The use of a Back-hoe for puncturing drums of this nature will almost certainly cause injury to the operator and damage to the back-hoe in the case of an eruption or explosion of the contents of the drum.

It is felt by many in the field of Hazardous Materials Response that a new method of operation is needed to handle the problem of not being able to remotely open drums which may contain hazardous materials.

Accordingly I claim the object of this invention: to provide a portable remotely operational drum opening device and method of operation that will provide a safe, simple, and inexpensive alternative to manually opening drums that may contain hazardous materials or by virtue of their physical condition may cause damage to person(s) or property upon opening.

BRIEF OVERVIEW OF THE INVENTION

With the advent of this invention it will be possible to remotely open hazardous drums from a safe distance, thus posing little threat of injury to the operator. This is accomplished by the use of an air or hydraulic powered cylinder which drives a punch to pierce the head of the drum, or by a air or hydraulic powered motor which turns a bung socket to remove the bung from the drum. The air or hydraulic mechanisms are mounted on an adjustable frame that is attached to the drum. A power supply is attached to the remote opening device by a sufficient length of hose to allow the operator to be stationed a safe distance away. This allows the operator to initiate the opening of the drum from a safe distance by simply rotating a valve to supply power to the remote opening device. The device is portable, lightweight and designed so that it may be installed by a single individual of average strength and dexterity.

Since the operation of air cylinders and motors is very similar to the operation of hydraulic cylinders and motors the description will be specific to the air operated devices. However, the present invention is not limited to the use of air operated cylinders and motors as will be apparent in the appended claims.

Installation of the remote drum opener with air motor and attached bung socket is as follows: loosen the two locking nuts on either side of the lateral tubes, hold the frame by one end, place the legs of the opposite end of the frame over the lip of the drum on the far side, pull the remote drum opener towards the near side of the drum, so to extend the lateral tubes, lower the frame to allow the legs of the near end of the frame to drop over the lip of the drum on the near side, adjust the frame so that the two mounting braces rest on the rim of the drum, release the frame to allow the bungee cords to retract the lateral tubes (this places the clamping bands in contact with the side of the drum), further adjust frame so that the air motor with attached bung socket is over the bung in the head of the drum, align the bung socket in the bung, loosen the locking bolts on the clamping bands, adjust clamping bands as necessary to obtain a good fit against the lower edge of the rim of the drum, tighten the locking bolts on the clamping bands and lateral tubes thus completing installation.

Installation of the remote drum opener with air cylinder and attached punch is the same as listed above for the air motor with the exception of placement in relation to the bung of the drum. The air cylinder with attached punch should be positioned in such a way as to allow the punch to pierce the head of the drum and not the bung.

DRAWING FIGURES

DESCRIPTION

Figure 1:
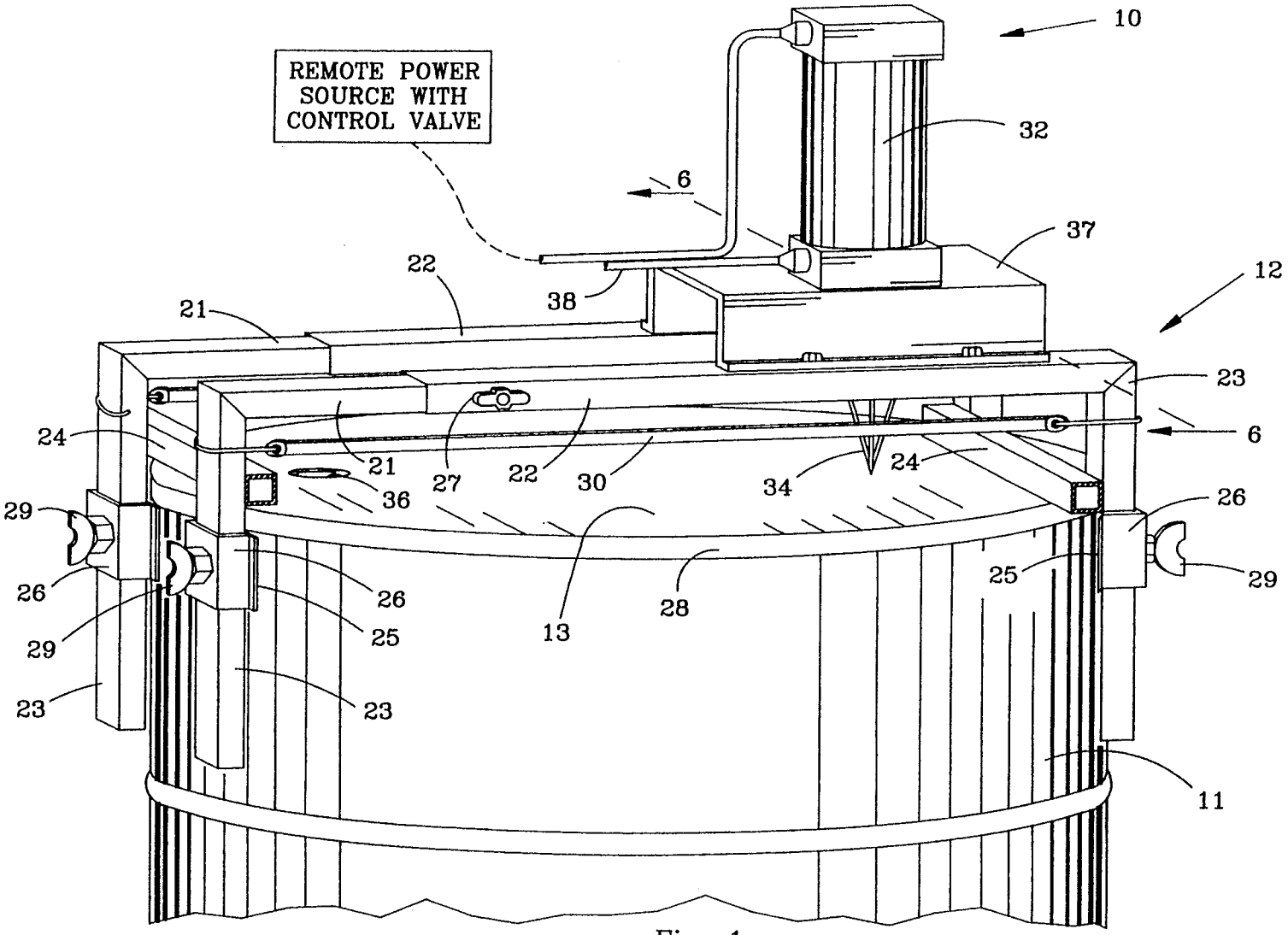
FIG. 1 shows a top left side view of the remote drum opener equipped with an air cylinder and attached punch, mounted on a 55 gallon drum.
Figure 2:
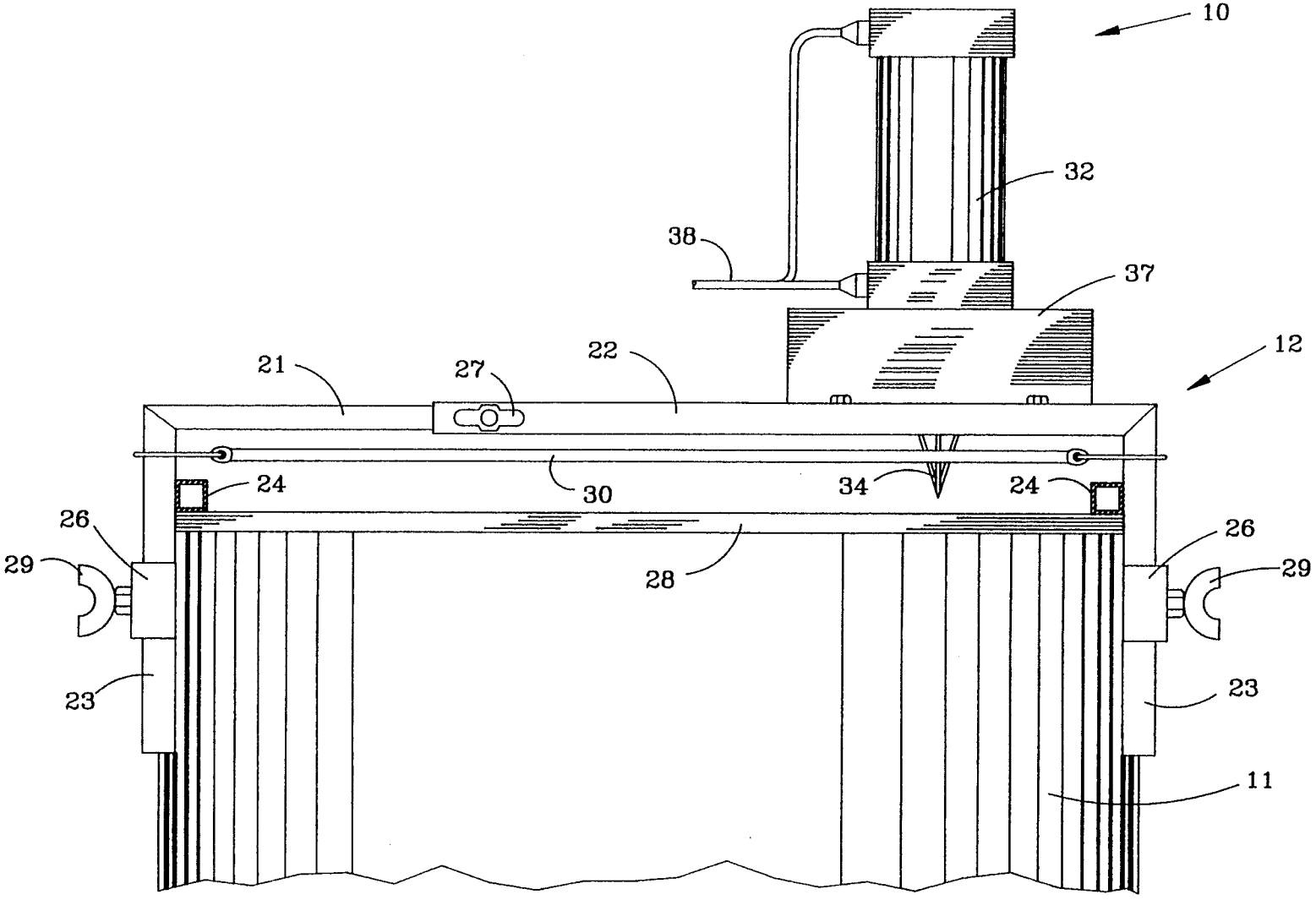
FIG. 2 shows a side view of such.
Figure 3:
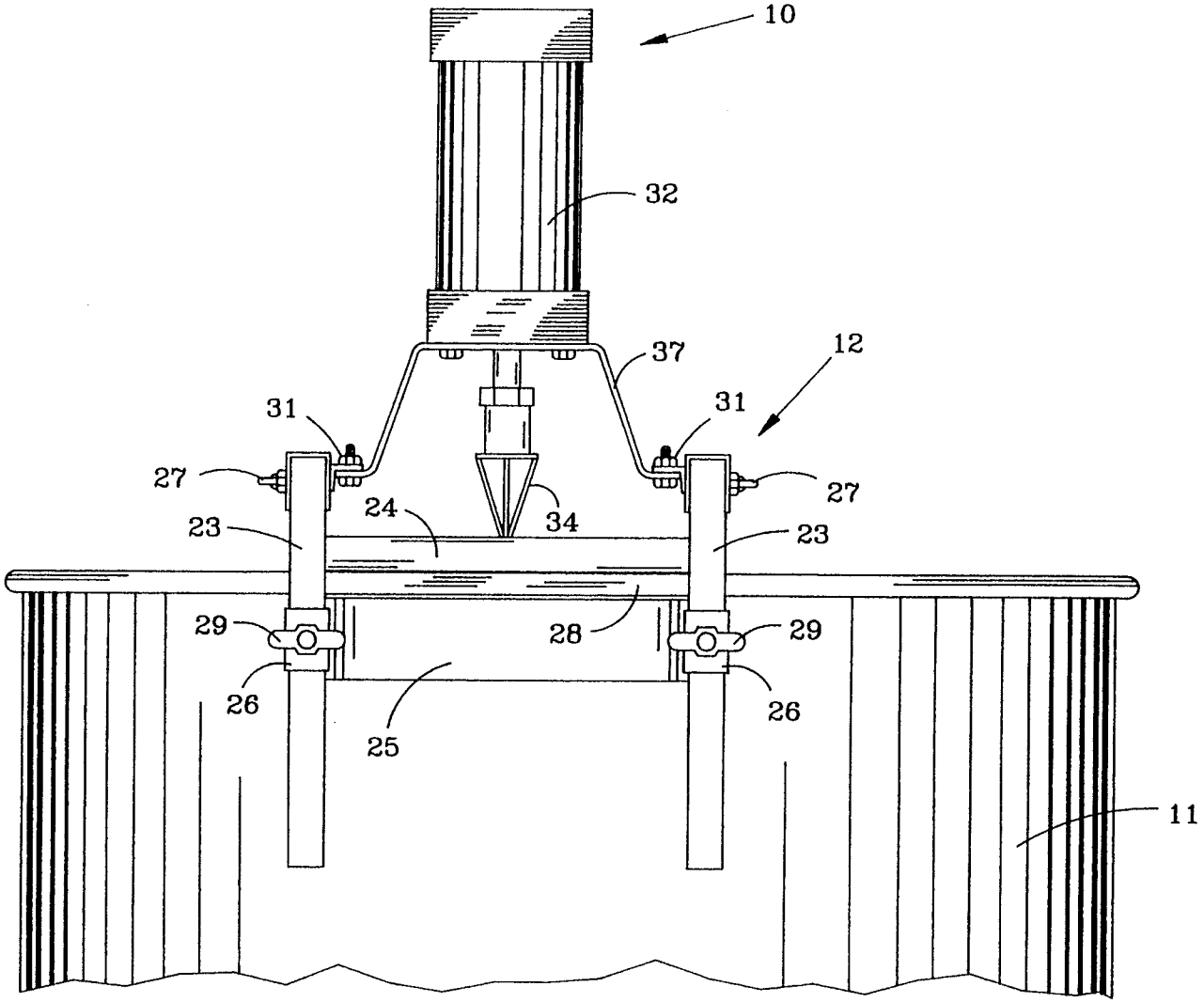
FIG. 3 shows a end view of such.
Figure 4:
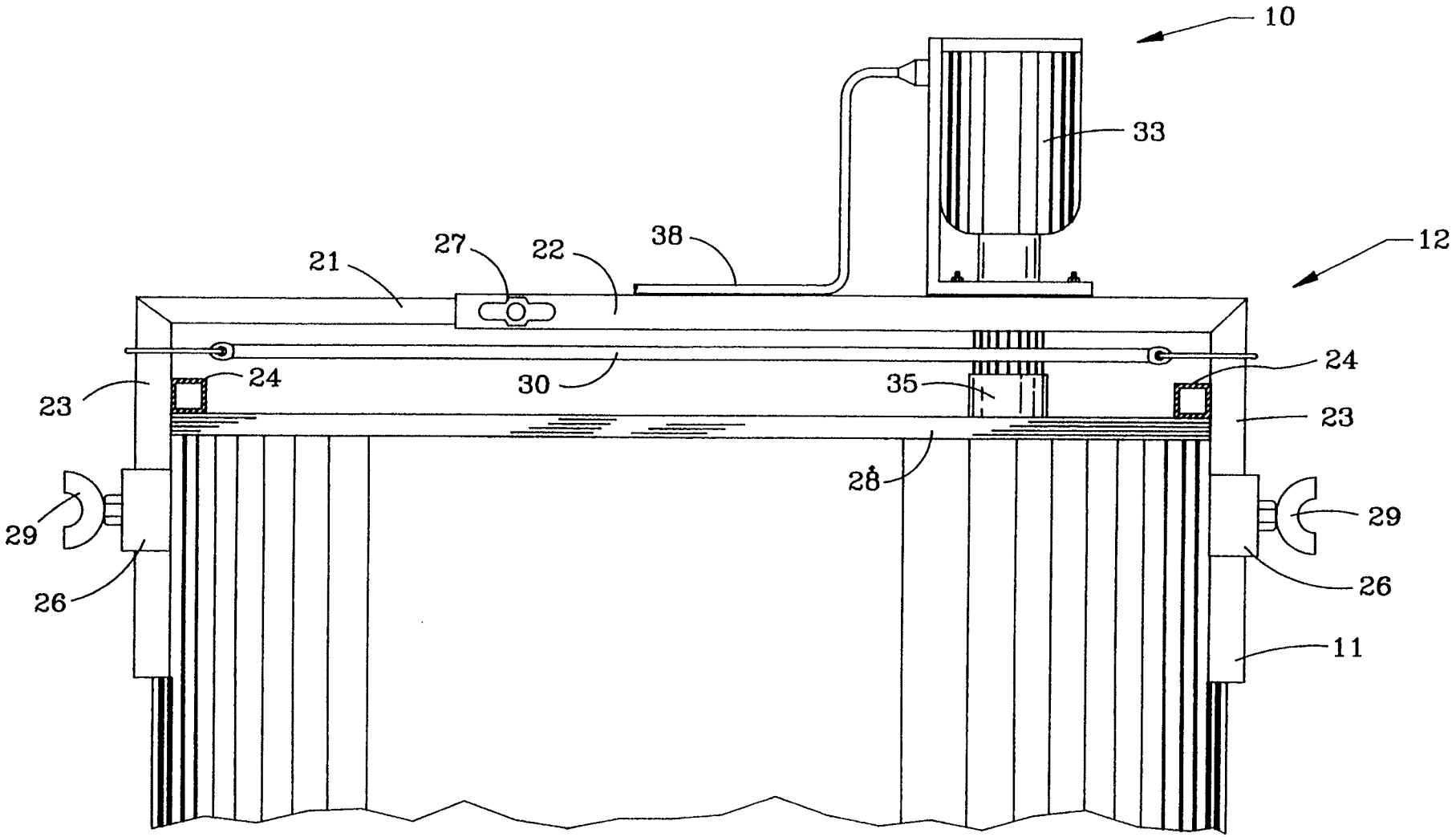
FIG. 4 shows a side view of the remote drum opener equipped with air motor and attached bung socket, mounted on a 55 gallon drum.
Figure 5:
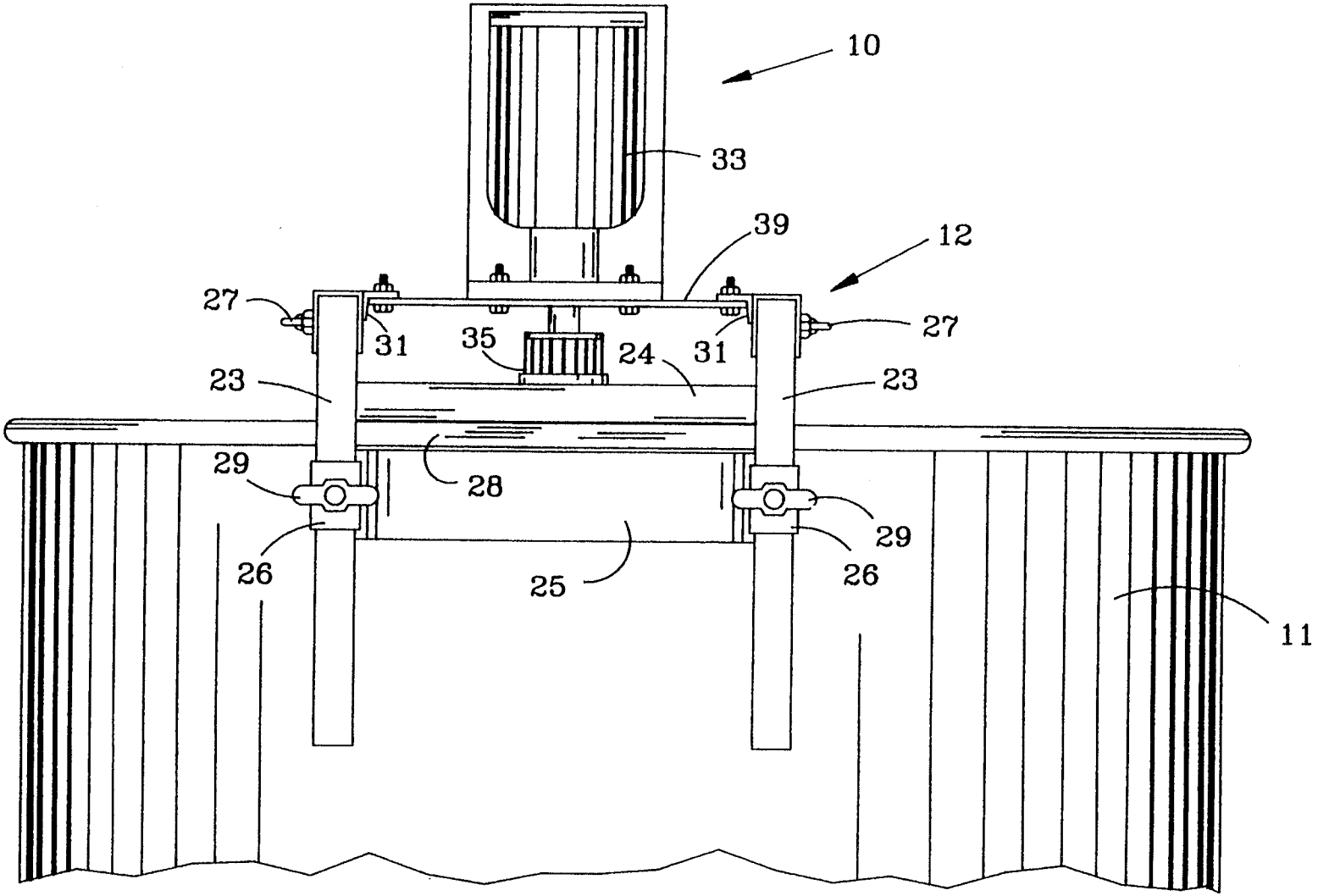
FIG. 5 shows a end view of such.
Figure 6:
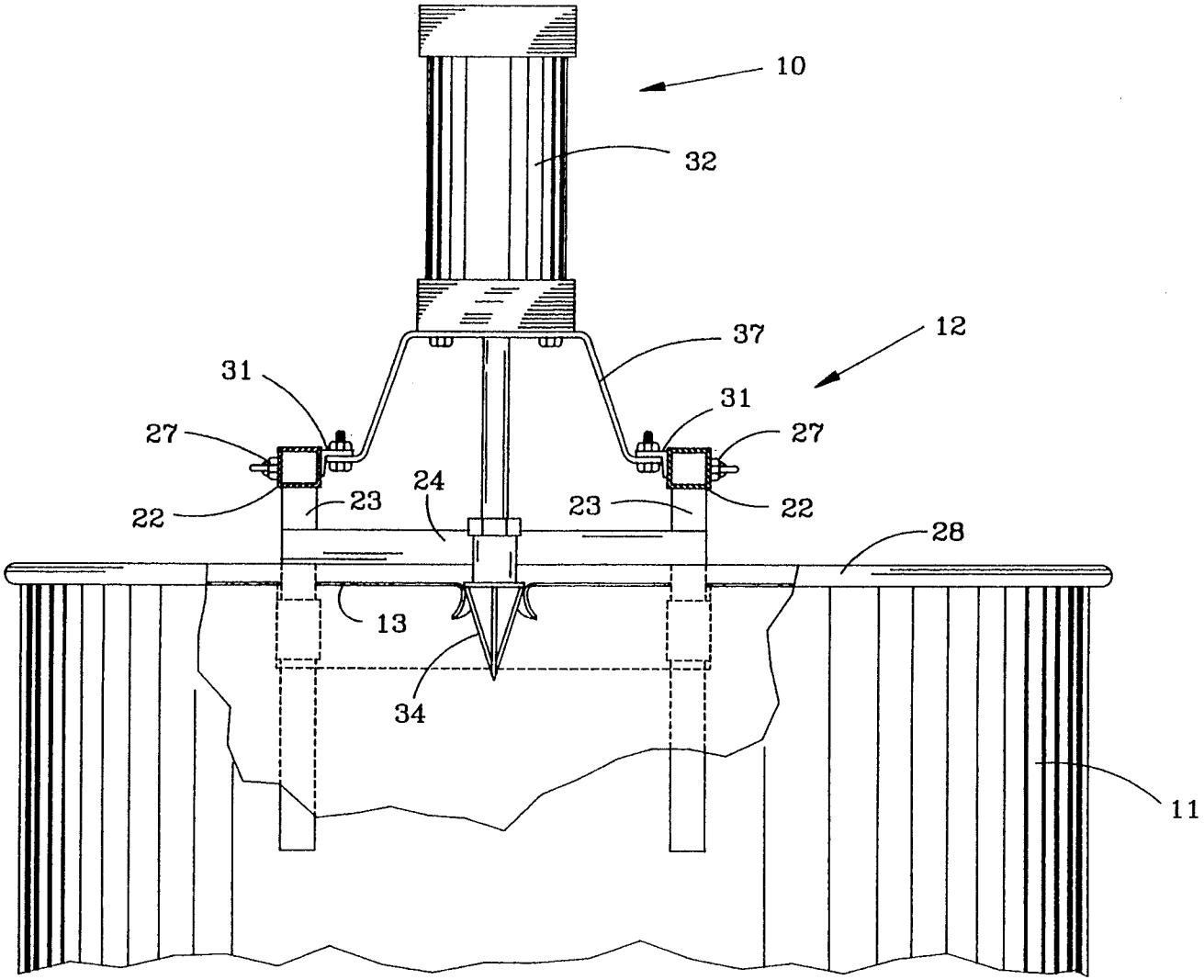
FIG. 6 shows a end sectional view of the remote drum opener equipped with air cylinder and attached punch, mounted on a 55 gallon drum with punch having penetrated the head of the drum. This view is taken along line 6—6 from FIG. 1.

Referring now to the drawing, the remote drum opener of the present invention is designated generally by the numeral 10. The drum to which it is affixed is designated by the numeral 11.

Remote drum opener 10 is adapted to be mounted on the end of drum 11. This is accomplished by use of adjustable frame 12 which is placed on the top of drum 11. Frame 12 is adjustable in two dimensions, horizontally, and vertically and is made up of two pairs of horizontal tubes 21 & 22, four vertical tubes (legs) 23, two connecting tubes 24, and two curved bands 25 with attached mounts 26. Horizontal tubes 21 are of smaller dimensions than horizontal tubes 22. This allows horizontal tubes 21 to slide inside horizontal tubes 22 thus making frame 12 adjustable in a horizontally telescoping manner. This allows frame 12 to be attached to the end of a variety of drum sizes. Horizontal tubes 22 are equipped with locking bolts 27 which when tightened against horizontal tubes 21 prevent slippage of frame 12 during operation. Frame 12 has two pair of legs 23 which extend down the side of drum 11. Legs 23 are held together by mounting brace 24 (a length of tubing which is welded to the legs). Mounting brace 24 also serves as a base for frame 12 and sits on drum rim 28 during operation. Each pair of legs 23 has a curved metal clamping band 25 which is shaped to conform to the sides of drum 11 and is adjustable up and down the length of legs 23 by use of attached mounts 26. Clamping bands 25 allow the frame to be adjusted to various configurations of drum rim 28. Locking nuts 29 are provided to secure clamping bands 25 to legs 23 preventing slippage during operation. Bungee cords 30 are attached across the length of frame 12 to aid in installation, bungee cords 30 apply inward pressure on legs 23 and clamping bands 25, fitting them snugly against the side of drum 11. Horizontal tubes 22 are equipped with angled mounting brackets 31, these are supplied for the mounting of desired opening device 32 or 33.

Two methods of operation are provided for opening drum 11. Method one is air cylinder 32 with attached punch 34 which is used to pierce drum head 13 thus producing an opening in drum 11. This opening provides access to the contents of drum 11 from which a sample may be obtained. Method two is air motor 33 with attached bung socket 35. This is used to remove bung 36 from drum head 13, this also provides an opening to the contents of drum 11 from which a sample may be obtained. Mounting flange 37 is used to attach air cylinder 32 to frame 12. Mounting flange 39 is used to attach air motor 33 to frame 12. The air supply (FIG. 1) is connected to air device 32 or 33 by a section of double line air hose 38 which is attached to an air control valve (FIG. 1) at the air supply. The operation of this valve provides power to remote drum opener 10 thus allowing drum 11 to be opened remotely. After opening of drum 11 is completed operator removes remote drum opener 10 and proceeds to take sample of, or dispose of, contents of said drum 11 according to environmental laws. Remote drum opener 10 is supplied with double line air hose 38 to provide flow in two directions thus allowing both clockwise and counter-clockwise operation of the air motor 33, or reciprocating operation of the air cylinder 32.

It will be obvious to those skilled in the art that there are modifications and variations of the present invention as described above. Further, it is to be understood that the attached description of this invention is the current preferred construction. Changes in shape, size, arrangement of parts, and substitutions of equivalent materials would be obvious to those skilled in the art. Also, uses and modes of operation other than those described, such as alternative methods of securing the invention to the drum, and alternative placements on the drum would be obvious to those skilled in the art. Accordingly, this description is to be taken only as an illustration and is bounded only by the scope of the appended claims.

I claim:

1. A system for opening drums that may contain hazardous materials without exposing an operator to contamination from materials in the drum or injury in the act of opening the drums, comprising in combination:

a power driven opening mechanism, a framework for firmly attaching the opening mechanism in place on the drum in a position for opening the drum, a power line for carrying power to operate said mechanism from a remote location away from the drums whereby said operator is not exposed to contamination or injury, manually operable control means at said remote location, wherein said drum has a substantially cylindrical outer periphery with an upper end with a substantially flat surface surrounded by a rim and wherein said framework further comprises a bracket extending diametrically across the flat surface and terminating in clamping members extending downwardly to mate with the cylindrical drum outer periphery.

2. The system of claim 1 wherein said bracket extending diametrically across the flat surface comprises telescoping means for adjusting the length of said bracket, thereby to fit different drum diameters.

3. The system of claim 2 wherein the opening mechanism comprises a punch for punching through the drum operable by an accompanying reciprocatable hydraulic cylinder mounted on said bracket for engaging the punch with said flat surface of the drum.

4. A system for opening drums that may contain hazardous materials without exposing an operator to contamination from materials in the drum or injury in the act of opening the drums, comprising in combination:

a power driven opening mechanism, a framework for firmly attaching the opening mechanism in place on the drum in a position for opening the drum, a power line for carrying power to operate said mechanism from a remote safe location away from the drums whereby said operator is not exposed to contamination or injury, and manually operable control means at said remote location, wherein the opening mechanism comprises a bung rotation wrench operable by a rotary reversible motor.

5. The system of claim 4 wherein the motor is pneumatically powered, and said power line comprises two lines for respectively driving the motor in opposite directions.

* * * * *